US006179643B1

(12) United States Patent
Fukuda

(10) Patent No.: US 6,179,643 B1
(45) Date of Patent: Jan. 30, 2001

(54) CONNECTOR LOCK MECHANISM

(75) Inventor: Masaru Fukuda, Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/592,810

(22) Filed: Jun. 13, 2000

(30) Foreign Application Priority Data

Jun. 16, 1999 (JP) ..... 11-169986

(51) Int. Cl.[7] ..... H01R 13/627
(52) U.S. Cl. ..... 439/358; 439/354; 439/353
(58) Field of Search ..... 439/358, 357, 439/353, 354, 352

(56) References Cited

U.S. PATENT DOCUMENTS

| | | | | |
|---|---|---|---|---|
| 5,030,127 | * | 7/1991 | Blasko et al. | 439/358 |
| 5,391,090 | * | 2/1995 | Power | 439/354 |
| 5,785,546 | * | 7/1998 | Hamai et al. | 439/354 |
| 5,980,297 | * | 11/1999 | Sugie | 439/354 |

FOREIGN PATENT DOCUMENTS 10-41014 2/1998 (JP) .

* cited by examiner

*Primary Examiner*—Paula Bradley
*Assistant Examiner*—Tho D. Ta
(74) *Attorney, Agent, or Firm*—Sughrue, Mion, Zinn, Macpeak & Seas, PLLC

(57) ABSTRACT

In a lock mechanism (30), an elastic arm (15) includes a pair of parallel elastic piece portions (18, 18) which define opposite side portions thereof, respectively, and extend in a fitting direction. The elastic piece portions (18, 18) can be elastically deformed inwardly toward an axis of a gap (17), and can be elastically restored into their original shape. A pair of engagement projections (19, 19) are formed on outer side edges (18B, 18B) of the elastic piece portions (18, 18), respectively. A width of that portion of each elastic piece portion (18), extending forwardly from the engagement projection (19), is smaller than a width of that portion of the elastic piece portion (18) extending rearwardly from the engagement projection (19) so that this front portion can be elastically deformed inwardly more easily than the rear portion. A length of the front portion of the elastic piece portion (18), extending forwardly from the engagement projection (19), is larger than a length of the rear portion of the elastic piece portion (18) extending rearwardly from the engagement projection (19).

4 Claims, 8 Drawing Sheets

CONNECTOR LOCK MECHANISM

BACKGROUND OF THE INVENTION

1. Field of the Invention

The present invention relates to a connector lock mechanism in which when a pair of male and female connectors are fitted together, connection terminals in the male connector are electrically connected respectively to connection terminals in the female connector. More particularly, the present invention relates to a connector lock mechanism having a mechanism for urging the male and female connectors in respective disengaging directions away from each other when the two connectors, each having the connection terminals received therein, are in a half-fitted condition.

The present application is based on Japanese Patent Application No. Hei. 11-169986, which is incorporated herein by reference.

2. Description of the Related Art

A pair of male and female connectors have heretofore been used for electrically connecting a plurality of wires. When the male and female connectors are fitted together, connection terminals, received in a housing of the male connector, contact connection terminals, received in a housing of the female connector, so that the former connection terminals are electrically connected to the latter connection terminals, respectively.

When the male and female connectors are incompletely or half fitted together, the electrical connection sometimes fails to be achieved. For example, Unexamined Japanese Patent Publication No. Hei. 10-41014 discloses male and female connectors which are disengaged from each other when the two connectors are in an incompletely-fitted or half-fitted condition, thereby preventing the male and female connectors from being kept in such a half-fitted condition.

In a connector lock mechanism 50 shown in FIG. 8, and also disclosed in Unexamined Japanese Patent Publication No. Hei. 10-41014, male connection terminals 52 are received in a female connector 51, and female connection terminals 54 are received in a male connector 53.

An elastic retaining piece portion 55, formed on the male connector 53, is engaged with an engagement projection 56, formed on the female connector 51, thereby locking the male and female connectors 53 and 51 to each other in a fitted condition.

The engagement projection 56 has a triangular cross-section defined by a gently-slanting surface 56A and an abruptly-slanting surface 56B. Therefore, when the two connectors 51 and 53 are in an incompletely-fitted or half-fitted condition, a distal end 55A of the elastic retaining piece portion 55 slides down the gently-slanting surface because of its own restoring force, so that the two connectors 51 and 53 are separated from each other in their respective disengaging directions.

In contrast, when the two connectors 51 and 53 are completely fitted together, so that the male connection terminals 52 are electrically connected respectively to the female connection terminals 54, the distal end 55A of the elastic retaining piece portion 55 slides down the abruptly-slanting surface 56B, and is completely engaged with the engagement projection 56. As a result, the two connectors 51 and 53 are locked to each other in a positively-fitted condition.

In the above connector lock mechanism 50, when the two connectors 51 and 53 are to be disengaged from each other, the distal end 55A of the elastic retaining piece portion 55 is lifted out of engagement with the engagement projection 56. However, the elastic retaining piece portion 55 can not be easily elastically deformed upwardly, and therefore the operation for canceling the fitted condition could not be easily carried out.

And besides, when a half-fitted condition is encountered, this is detected through the resilient force of the elastic retaining piece portion 55. However, when the number of connection terminals increases, a large disengaging force is required, and when the angle of inclination of the gently-slanting surface 56A is increased, there have been encountered problems that the connector becomes bulky in size and that the burden on the elastic retaining piece portion 55 increases.

SUMMARY OF THE INVENTION

With the above problems in view, it is an object of the present invention to provide a connector lock mechanism in which a fitted condition of a pair of connectors can be easily canceled, and a half-fitted condition can be precisely detected, and besides a compact design of the connector can be achieved.

To achieve the above object, according to the first aspect of the present invention, there is provided a connector lock mechanism which comprises an elastic arm formed on one of a pair of connectors which are fittable to each other, the elastic arm being elastically deformed when the one of the pair of connectors is fitted into a fitting recess portion formed in the other one of the pair of connectors, the elastic arm including a pair of elastic piece portions which serve as opposite side portions of the elastic arm, a pair of engagement projections respectively formed on outer side surfaces of the elastic piece portions, wherein portions of the elastic piece portions, extending from the engagement projections in a connector fitting direction, are formed to be capable of easily elastically deforming inwardly, slanting push-out guide surfaces, on which the engagement projections slide when the one of the pair of connectors is fitted into and disengaged from the fitting recess portion, formed respectively on opposite inner side surfaces of the fitting recess portion, and engagement portions respectively formed on the opposite inner side surfaces of the fitting recess portion, the engagement portions retaining the engagement projections when the one of the pair of connectors is completely fitted in the fitting recess portion.

According to the second aspect of the present invention, the connector lock mechanism may further comprises retaining projections respectively formed on the elastic piece portions, and a retaining portion retaining the retaining projections, the retaining portion being formed on an inner surface of the fitting recess portion of the other one of the pair of connectors.

According to the third aspect of the present invention, the portions of the elastic piece portions, extending from the engagement projections in the connector fitting direction, may be thinner than portions of the elastic piece portions extending rearwardly from the engagement projections.

According to the fourth aspect of the present invention, respective length of the portions of the elastic piece portions, extending from the engagement projections in the connector fitting direction, may be larger than respective length of portions of the elastic piece portions extending rearwardly from the engagement projections.

Namely, each of the elastic piece portions may become narrower progressively from the rear portion, disposed rearwardly of the engagement projection, toward the front end thereof, or the length of that portion of the elastic piece portion, extending from the engagement projection to the front end thereof, may be larger than that portion of the elastic piece portion extending from the engagement projection to the rear end thereof. Alternatively, the two arrangements can be used in combination.

In the connector lock mechanism of the present invention, the amount of flexing (elastic deformation) of the elastic arm, disposed forwardly of the engagement projections, can be increased, and therefore the elastic piece portions receive pressing forces respectively from the push-out guide surfaces through the respective engagement projections, and also the retaining projections on the elastic arm receive a pressing force from the retaining portion. Therefore, until the two connectors are completely fitted together, the one connector receives a large disengaging force (acting in the disengaging direction) from the other connector, so that an incompletely-fitted or half-fitted condition of the two connectors can be precisely detected.

When the two connectors are completely fitted together, the retaining projections are retained by the retaining portion, and also the engagement projections are retained by the engagement portions, respectively, so that the elastically-deformed elastic piece portions are restored into their original shape. As a result, the two connectors are firmly locked to each other, and the terminals in the one connector are electrically connected to the terminals in the other connector.

For canceling the engagement of the retaining projections (on the elastic arm) with the retaining portion so as to disengage the two connectors from each other, the elastic arm is depressed to be elastically flexed or displaced, so that the elastic piece portions are displaced in this flexing direction together with the elastic arm. At this time, the engagement projections, formed respectively on the elastic piece portions, are guided respectively onto the push-out guide surfaces, thereby producing a large disengaging force as produced during the fitting operation, and therefore the two connectors can be easily disengaged from each other.

And besides, if the required disengaging force is generally of the same level as in the conventional construction, the inclination angle of the push-out guide surfaces can be reduced, and therefore the connector can be formed into a compact design.

DETAILED DESCRIPTION OF THE PREFERRED EMBODIMENT

One preferred embodiment of a connector lock mechanism of the present invention will now be described in detail with reference to FIGS. 1 to 7B.

Figure 1:
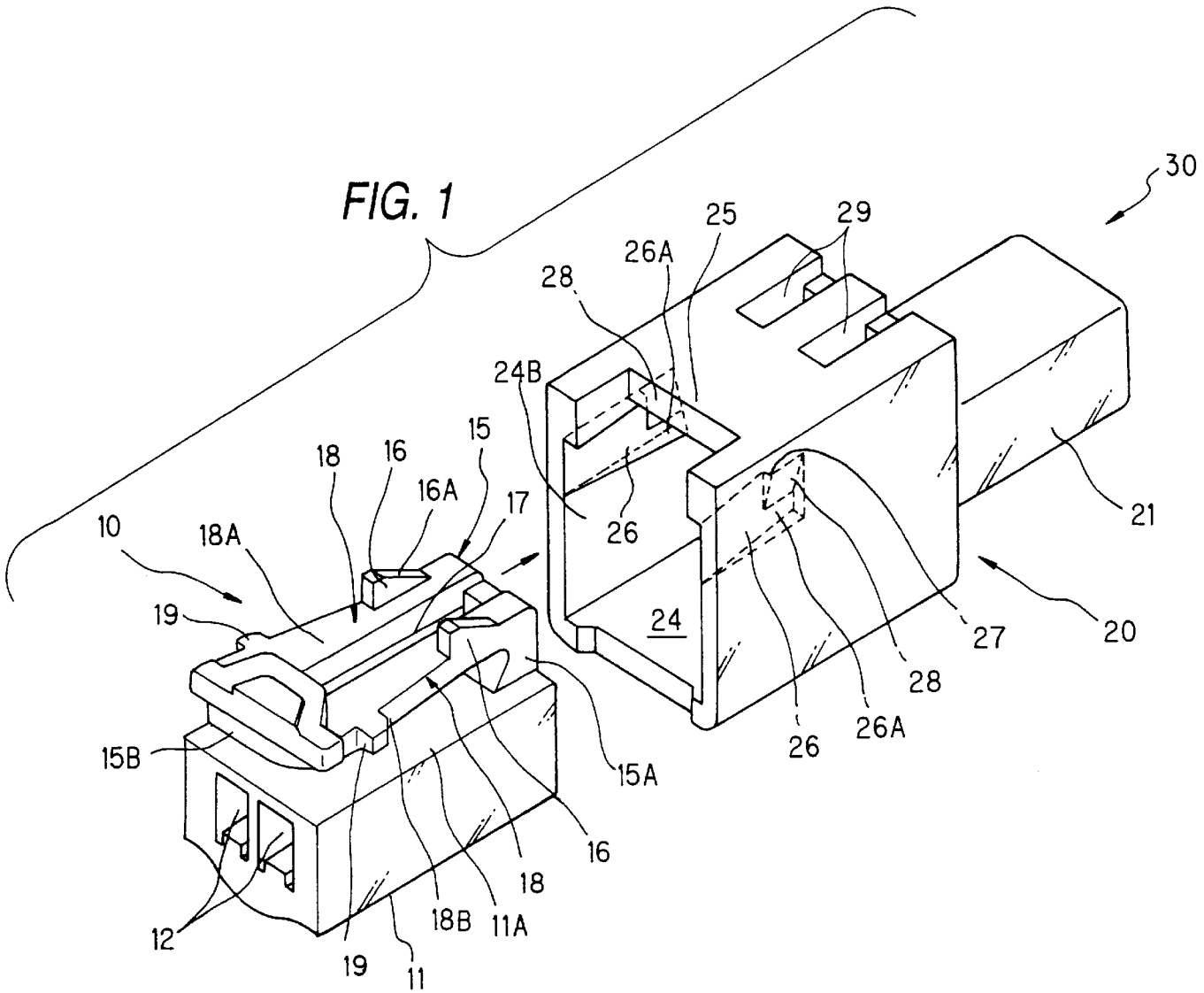
FIG. 1 is an exploded, perspective view of one preferred embodiment of a connector lock mechanism of the present invention.
Figure 2:
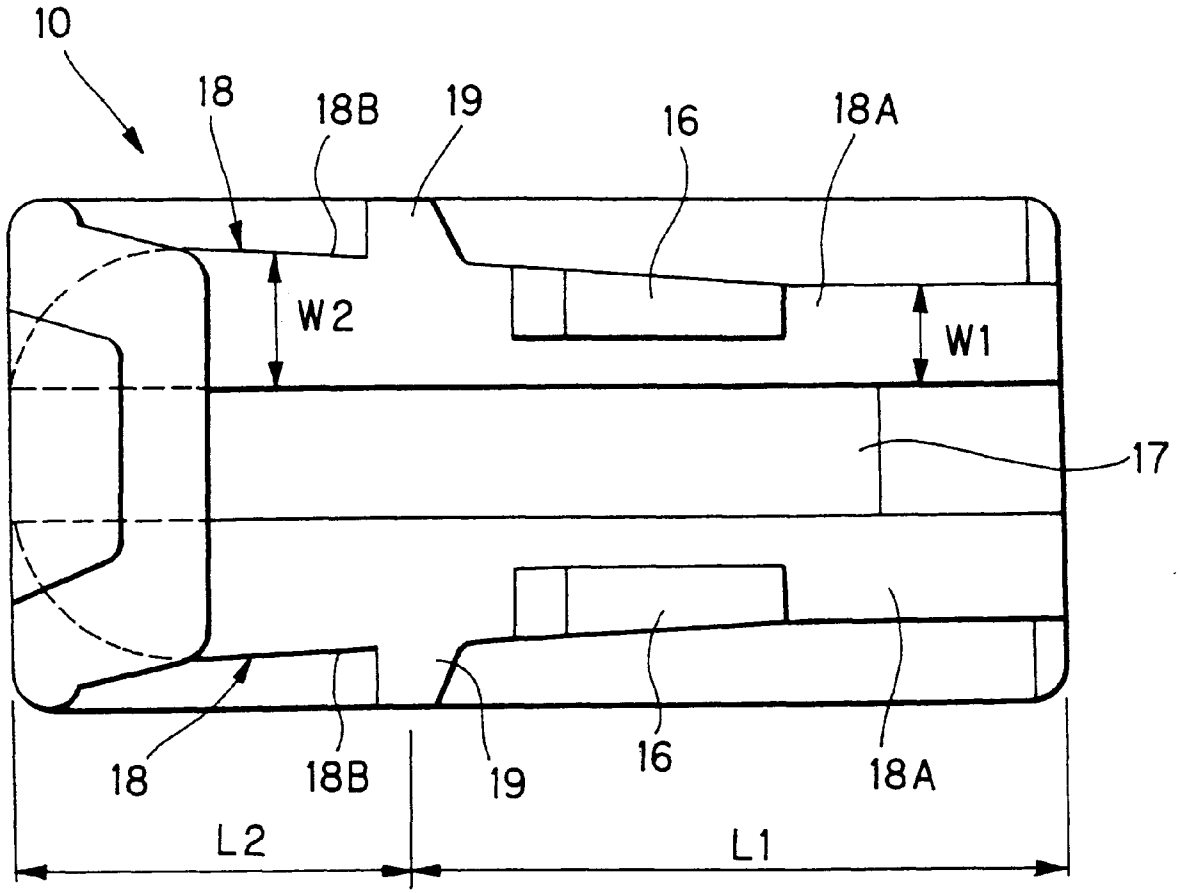
FIG. 2 is a plan view showing the construction of a male connector.
Figures 3A, 3B:
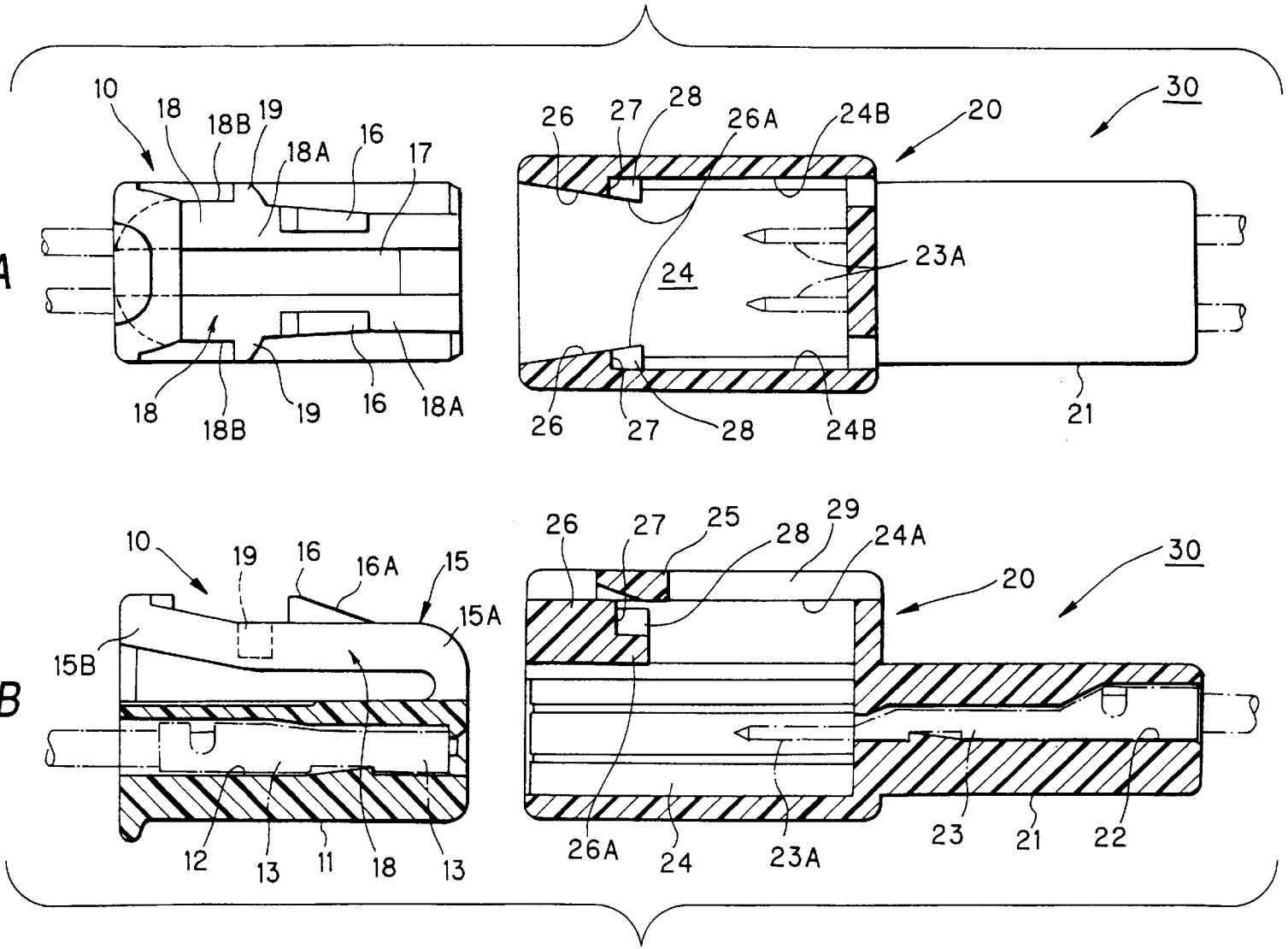
FIGS. 3A and 3B are cross-sectional views of the male and female connectors in FIG. 1.

As shown in FIGS. 1 to 3, the connector lock mechanism 30 of this embodiment comprises the pair of male and female connectors 10 and 20 to be fitted together. The male connector (one connector) 10 has terminal receiving chambers 12 formed longitudinally through a housing body 11 thereof. Female terminals 13, each fixedly secured to an end portion of a wire, are received in the terminal receiving chambers 12, respectively. A front end portion 15A of an elastic arm 15 is formed on and projects from an upper surface 11A of the housing body 11 at a front end portion thereof, and a free end portion 15B of the elastic arm 15 extends toward a rear end of the housing.

The elastic arm 15 has such a shape that the front end portion 15A has a smaller width while the free end portion 15B has a larger width, and a gap 17, serving as a flexure space, is formed in a widthwise-central portion of the elastic arm 15. A pair of retaining projections 16 and 16 are formed on an upper surface 18A of the elastic arm 15 in adjacent relation to the front end portion 15A, and are disposed respectively on opposite sides of the gap 17. The pair of retaining projections 16 and 16 can be retained by a retaining portion 25 of the female connector 20 (described later). Each of the retaining projections 16 has a front surface 16A which is gently slanting downwardly forwardly.

The elastic arm 15 includes a pair of parallel elastic piece portions 18 and 18 which define opposite side portions thereof, respectively, and extend in a fitting direction. The elastic piece portions 18 and 18 can be elastically deformed inwardly toward the axis of the gap 17, and can be elastically restored into their original shape. A pair of engagement projections 19 and 19 are formed on and project outwardly from outer side edges (outer side surfaces) 18B of the elastic piece portions 18 and 18, respectively.

A feature of the connector lock mechanism 30 of this embodiment is that a width W1 of that portion (front portion) of each elastic piece portion 18 (of the male connector 10), extending forwardly from the center of the engagement projection 19, is smaller than a width W2 of that portion (rear portion) of the elastic piece portion 18 extending rearwardly from the center of the engagement projection 19 (as shown in FIG. 2) so that this front portion can be elastically deformed inwardly more easily than the rear portion. Namely, the front portion of the elastic piece portion 18 is narrower than the rear portion thereof.

A length L1 of the front portion of the elastic piece portion 18, extending forwardly from the center of the engagement projection 19, is larger than a length L2 of the rear portion of the elastic piece portion 18 extending rearwardly from the center of the engagement projection 19. Namely, the engagement projection 19, formed on the elastic piece portion 18, is disposed closer to the rear end thereof than to the front end thereof.

In the male connector 10 of this construction, that portion of the elastic arm 15, disposed forwardly of the engagement projections 19, can be elastically deformed in a larger amount, and therefore a half-fitted condition of the male and female connectors 10 and 20 during the connector-fitting operation can be detected with high precision.

The female connector (the other connector) 20 has terminal receiving chambers 22 formed in a housing body 21 thereof. Male terminals 23, each fixedly secured to an end portion of a wire, are received in the terminal receiving chambers 22, respectively. A front portion of the housing body 21 defines a fitting recess portion 24 for fitting on the male connector 10, and distal end portions of the male terminals 23 project into the interior of the fitting recess portion 24.

The retaining portion 25 for engagement with the retaining projections 16 of the elastic arm 15 is formed by an upper wall of the fitting recess portion 24 having an inner surface (upper surface in the drawings) 24A. The retaining portion 25 has a surface gently slanting upwardly forwardly to an edge of a front opening of the fitting recess portion 24. A pair of engagement grooves 29 for respectively receiving the pair of retaining projections 16 are formed through the upper wall, and extend rearwardly from the retaining portion 25.

A pair of push-out guide surfaces 26 and 26 are formed respectively on opposite side surfaces 24B and 24B of the fitting recess portion 24, and are disposed symmetrically with respect to the fitting direction. The distance between two push-out guide surfaces 26 and 26 is decreasing progressively away from the edge of the front opening of the fitting recess portion 24. A step surface 27, serving as an engagement portion, is formed at a rear end of each of the push-out guide surfaces 26, and is disposed perpendicular to the associated inner side surface 24B. The engagement projections 19 of the elastic arm 15 are engageable with the step surfaces 27, respectively. An extension surface 26A, disposed at the lower side of each step surface 27, extends forwardly, and a guide surface 28 is formed on this extension surface 26A, and extends upwardly-downwardly at the rear side of the step surface 27. The two guide surfaces 28 and 28 are slanting such that the distance between the two is decreasing progressively toward their lower ends.

Next, the operation of the connector lock mechanism 30 of the above construction will be described. First, the operation for fitting the male and female connectors 10 and 20 together will be described.

Figure 4A:
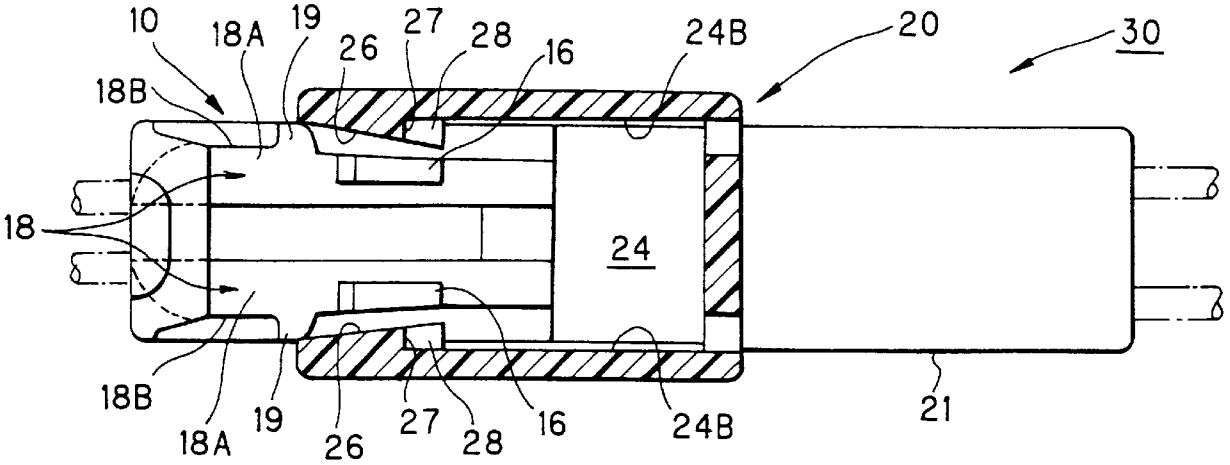
FIGS. 4A and 4B are views explanatory of an operation, showing a condition in which the male and female connectors begin to be fitted together.
Figure 4B:
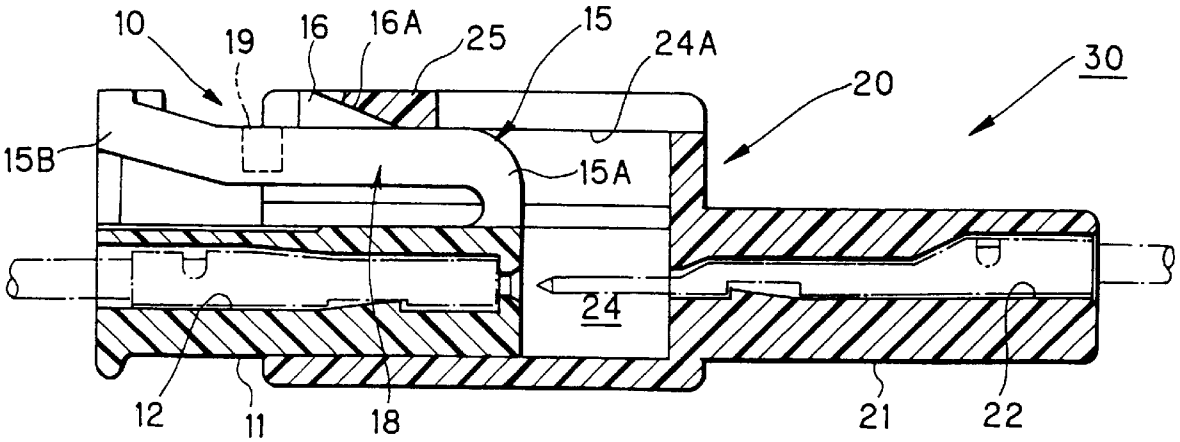

When the male connector 10 is fitted into the female connector 20 as shown in FIG. 4, the retaining projections 16 on the elastic arm 15 abut against the retaining portion 25 of the female connector 20, and also the engagement projections 19, formed respectively on the elastic piece portions 18, abut against the push-out guide surfaces 26, respectively.

Figure 5A:
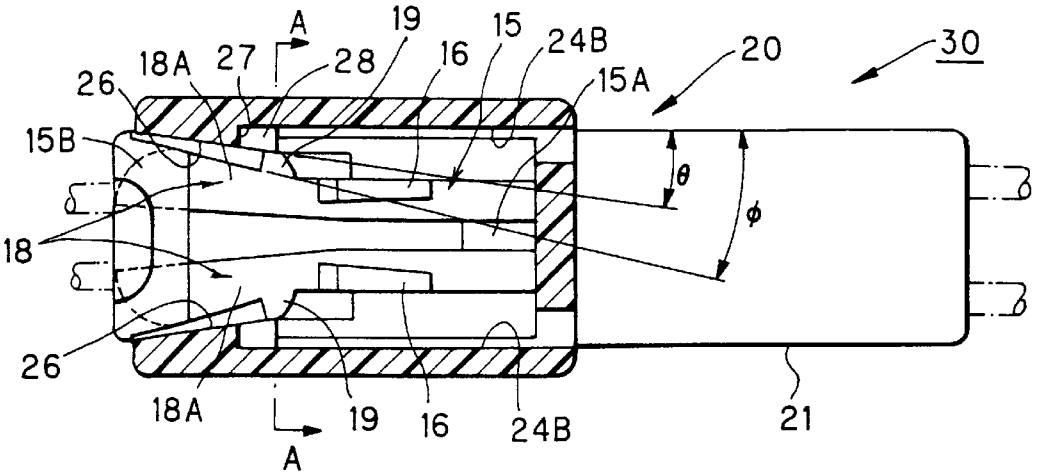
FIGS. 5A to 5C are views explanatory of the operation, showing the male and female connectors in a half-fitted condition.
Figure 5B:
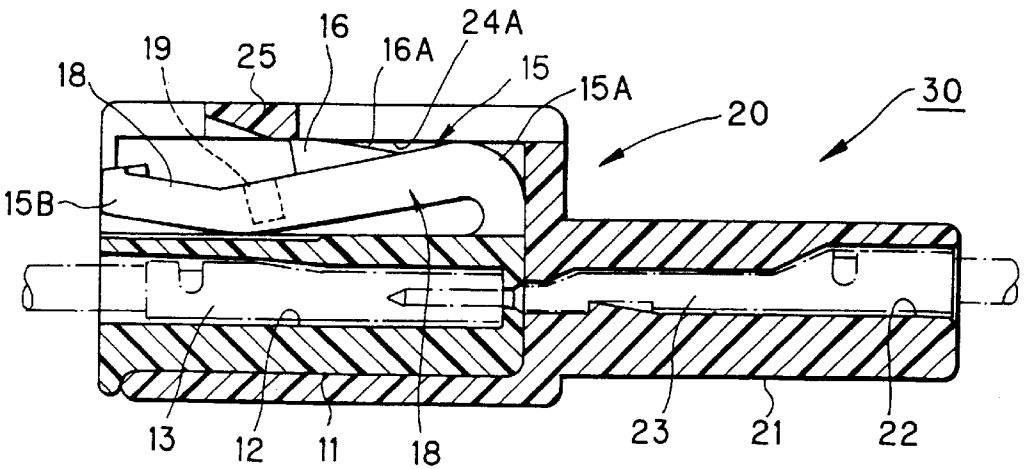
Figure 5C:
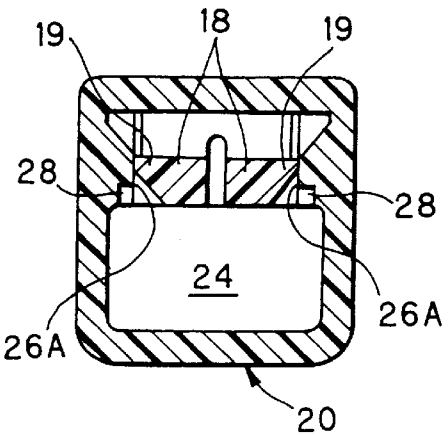

Then, when the male connector is further pushed into the female connector as shown in FIG. 5, the retaining projections 16 slide on the slanting surface of the retaining portion 25 of the female connector 20, so that the free end portion 15B of the elastic arm 15 is displaced toward the housing body 11, disposed beneath it, and also the front portions of the elastic piece portions 18 are much flexed (elastically deformed) inwardly, and the engagement projections 19 slide respectively on the push-out guide surfaces 26. In this manner, the male connector 10 is inserted into the female connector 20.

If the fitting operation is stopped when the two connectors 10 and 20 are not yet completely fitted together, the slanting surfaces 16A of the retaining projections 16 receive a pressing force from the slanting surface of the retaining portion 25 because of the elastic force of the elastic arm 15, and also the engagement projections 19 of the elastic piece portions 18, much flexed at their front portions, receive pressing forces from the push-out guide surfaces 26, respectively, so that the male connector 10 is pushed back in the disengaging direction by the large disengaging force. Therefore, a half-fitted condition of the two connectors 10 and 20 can be precisely detected.

Figure 6A:
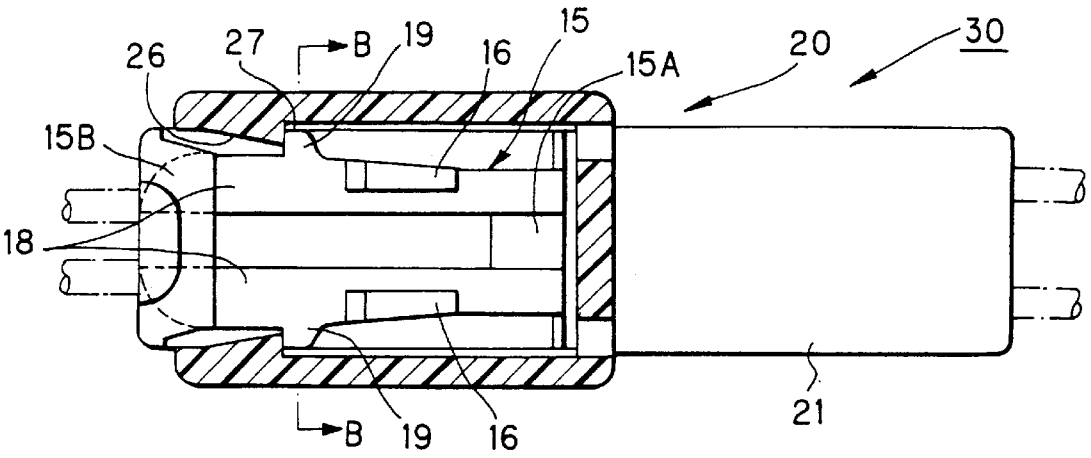
FIGS. 6A to 6C are views explanatory of the operation, showing the male and female connectors in a completely-fitted condition.
Figure 6B:
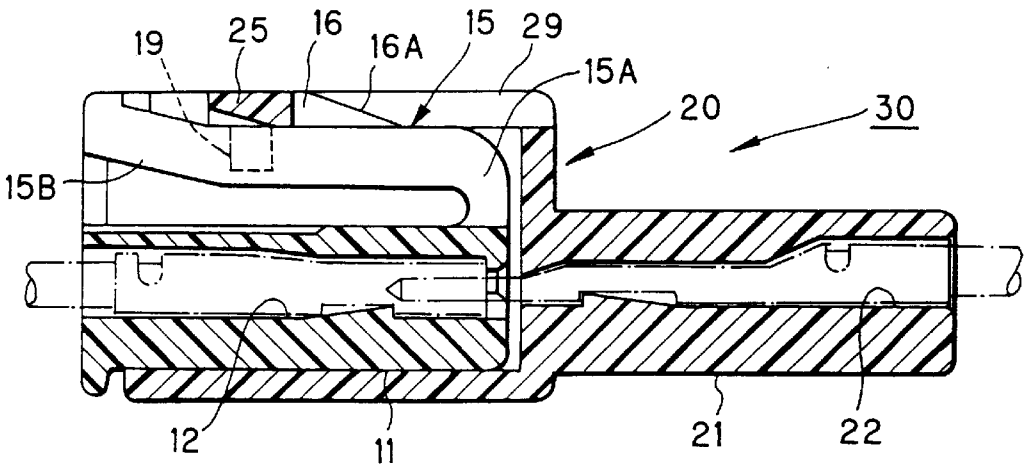
Figure 6C:
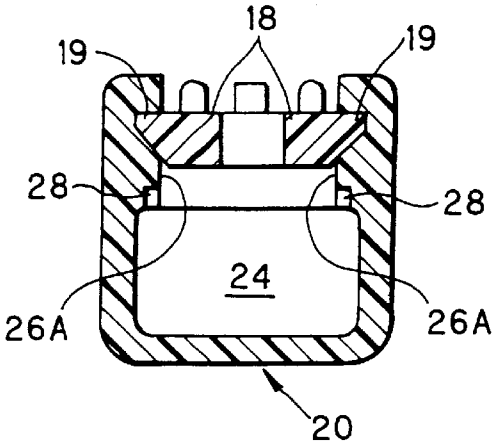

Then, when the male connector is further pushed into the female connector as shown in FIG. 6, the retaining projections 16 on the elastic arm 15 are fitted respectively in the engagement grooves 29, and are retained by the retaining portion 25, and also the engagement projections 19 are held respectively on the guide surfaces 28, and are retained respectively by the step surfaces 27, so that the male and female connectors 10 and 20 are completely fitted together. Thus, the male connector 10 is positively fitted in the female connector 20 against withdrawal therefrom, and the female terminals 13 are electrically connected to the male terminals 23, respectively.

Figure 7A:
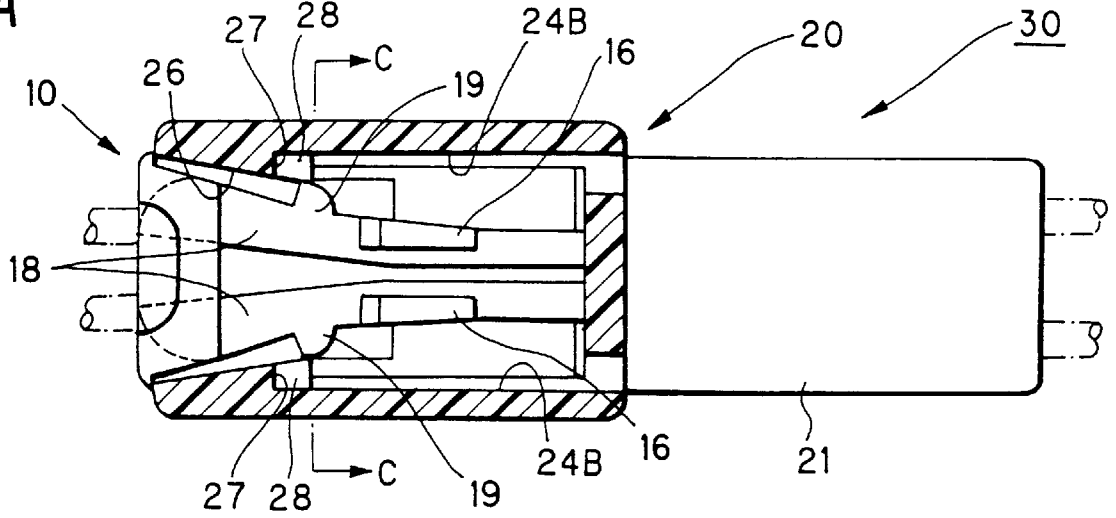
FIG. 7A and 7B are views explanatory of the operation, showing a condition in which the fitted condition of the male and female connectors is canceled.
Figure 7B:
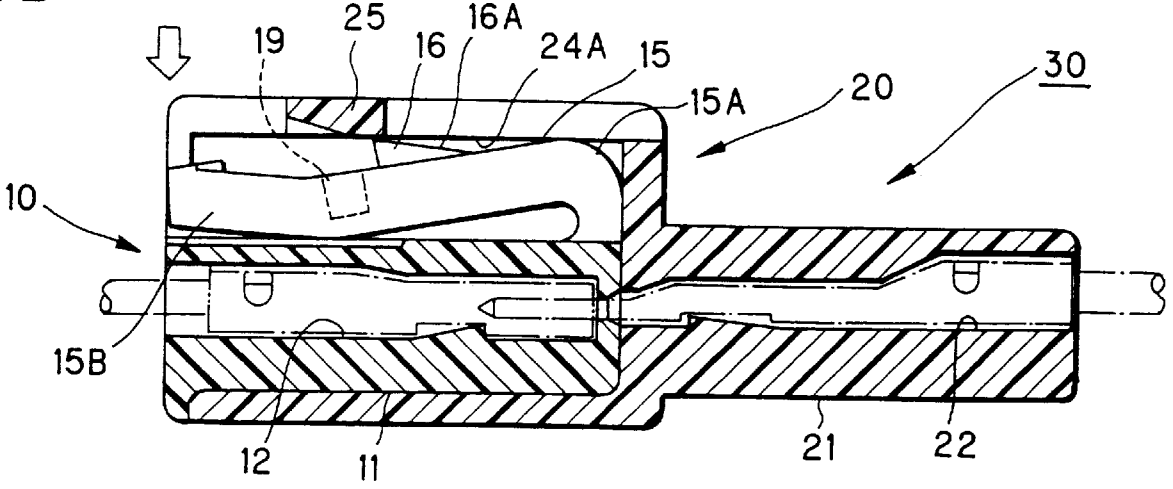
Figure 8:
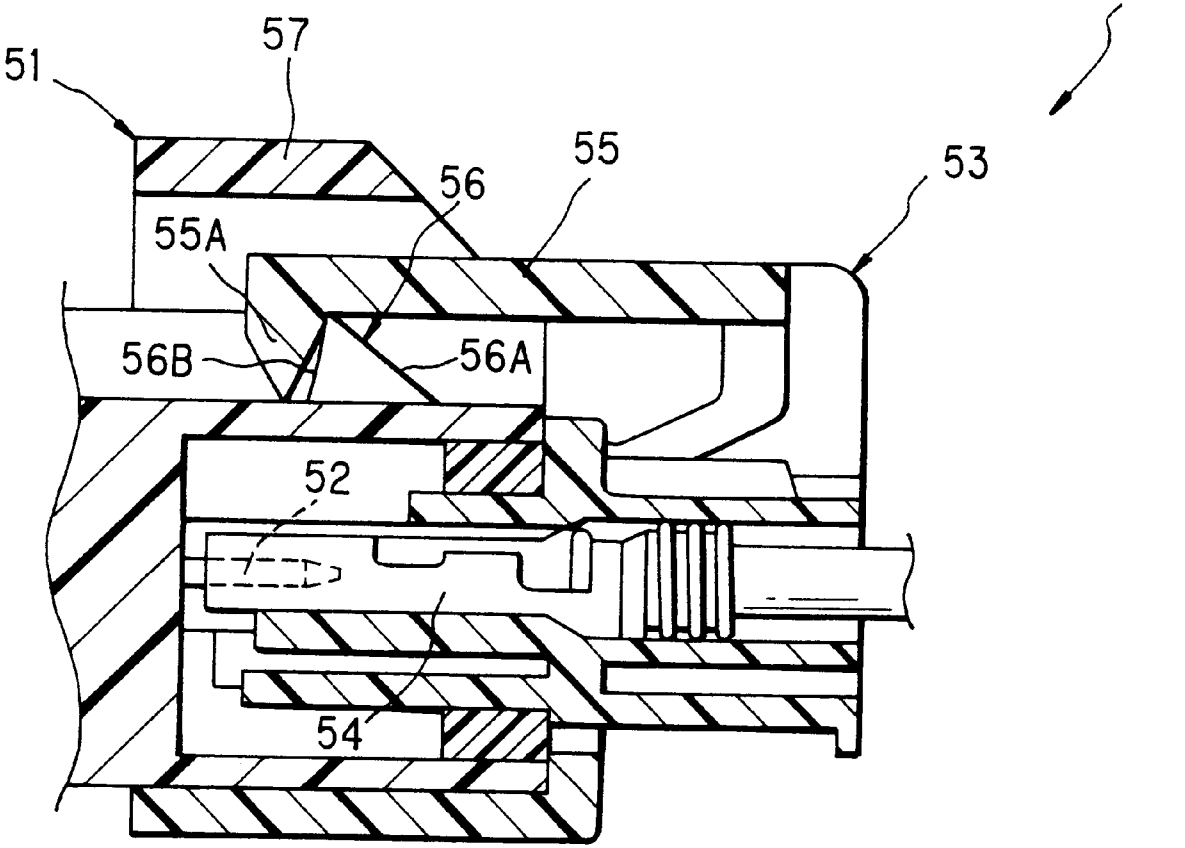
FIG. 8 PRIOR ART
FIG. 8 is a cross-sectional view of a conventional connector lock mechanism.

Next, the operation for disengaging the male connector 10 from the female connector 20 will be described with reference to FIG. 7. For disengaging the male connector 10 from the female connector 20, first, the free end portion 15B of the elastic arm 15 is pressed down with the finger or other to be displaced toward the housing body 11. As a result, the retaining engagement of the retaining projections 16 of the elastic arm 15 with the retaining portion 25 is canceled. At this time, in accordance with the elastic displacement of the elastic arm 15 toward the housing body 11, the engagement projections 19 slide down (in the drawings) respectively on the guide surfaces 28, and are held respectively on the extension surfaces 26A (see FIG. 1) of the push-out guide surfaces 26. Namely, simultaneously when the elastic arm 15 is elastically displaced, the retaining engagement of the engagement projections 19 with the respective step surfaces 27 is canceled.

When the engagement projections 19 are thus brought into contact with the extension surfaces 26A of the push-out guide surfaces 26, respectively, the front portions of the elastic piece portions 18 are much flexed inwardly, and the elastic piece portions 18 receive pressing forces respectively from the extension surfaces 26A of the push-out guide surfaces 26 through the respective engagement projections 19. Therefore, there is exerted the large disengaging force to disengage the male connector 10 from the female connector 20, so that the male connector 10 can be easily disengaged from the female connector 20.

In the connector lock mechanism 30 of this embodiment, in order to smoothly and positively effect the fitting connection between the male and female connectors 10 and 20 and the disengagement of the two connectors from each other, the width W1 of that portion (front portion) of each elastic piece portion 18, extending forwardly from the center of the engagement projection 19 is smaller than the width W2 of that portion (rear portion) of the elastic piece portion 18 extending rearwardly from the center of the engagement projection 19 so that this front portion can be elastically deformed inwardly more easily than the rear portion. Thus, the front portion of the elastic piece portion 18, extending forwardly from the engagement projection 19, is narrower than the rear portion thereof extending rearwardly from the engagement projection 19.

The length L1 of the front portion of the elastic piece portion 18, extending forwardly from the center of the engagement projection 19, is larger than the length L2 of the rear portion of the elastic piece portion 18 extending rearwardly from the center of the engagement projection 19. Namely, the engagement projection 19, formed on the elastic piece portion 18, is disposed closer to the rear end thereof than to the front end thereof.

The disengaging force F to push the male connector 10 outwardly when fitting and disengaging the male and female connectors 10 and 20 relative to each other is obtained from a formula, Wtan (ø−θ), where θ represents an inclination angle of the push-out guide surfaces 26 formed on the female connector 20, ø represents an inclination angle of the elastic piece portions 18, and W represents the force with which the engagement projections 19 press the push-out guide surfaces 26 outwardly because of the elastic force of the elastic piece portions 18 of the elastic arm 15. Thus, although the inclination angle θ of the push-out guide surfcaces 26 is constant, the inclination angle ø of the two elastic piece portions 18 is increased, and therefore the disengaging force F to push the male connector 10 out increases.

Thus, the amount of flexing (elastic deformation) of the front portion of the elastic arm, extending forwardly from the engagement projections 19, can be increased, and therefore a half-fitted condition of the male and female connectors 10 and 20 during the fitting operation can be easily detected, and also the disengaging operation can be effected easily. And besides, since the large disengaging force is produced, the highly-precise detection can be effected. Furthermore, if the required disengaging force is generally of the same level as in the conventional construction, the inclination angle of the push-out guide surfaces can be reduced, and therefore the connector can be formed into a compact design.

As described above, in the connector lock mechanism of the present invention, the opposite side portions of the elastic arm on the one connector define the pair of elastic piece portions, respectively, and the pair of engagement projections are formed respectively on the outer side surfaces of the elastic piece portions. The slanting push-out guide surfaces, on which the engagement projections slide, respectively, during the time when the one connector is fitted into and disengaged from the fitting recess portion, are formed respectively on the opposite inner side surfaces of the fitting recess portion of the other connector, and the engagement portions, which retain the engagement projections, respectively, when the one connector is completely fitted in the fitting recess portion, are formed respectively on the opposite inner side surfaces of the fitting recess portion. That portion of each of the elastic piece portions, extending forwardly from the engagement projection, can be easily elastically deformed inwardly.

Therefore, the amount of flexing (elastic deformation) of the elastic arm, disposed forwardly of the engagement projections, can be increased, and therefore until the two connectors are completely fitted together, the one connector receives the large disengaging force (acting in the disengaging direction) from the other connector, so that an incompletely-fitted or half-fitted condition of the two connectors can be precisely detected.

For canceling the engagement of the retaining projections (on the elastic arm) with the retaining portion so as to disengage the two connectors from lo each other, the elastic arm is depressed, so that the engagement projections, formed respectively on the elastic piece portions, are guided respectively onto the push-out guide surfaces, thereby producing the large disengaging force as produced during the fitting operation, and therefore the two connectors can be easily disengaged from each other.

And besides, if the required disengaging force is generally of the same level as in the conventional construction, the inclination angle of the push-out guide surfaces can be reduced, and therefore the connector can be formed into a compact design.

What is claimed is:

1. A connector lock mechanism, comprising:

an elastic arm formed on one of a pair of connectors which are fittable to each other, the elastic arm being elastically deformed when the one of the pair of connectors is fitted into a fitting recess portion formed in the other one of the pair of connectors, the elastic arm including a pair of elastic piece portions which serve as opposite side portions of the elastic arm;

a pair of engagement projections respectively formed on outer side surfaces of the elastic piece portions, wherein portions of the elastic piece portions, extending from the engagement projections in a connector fitting direction, are formed to be capable of easily elastically deforming inwardly;

slanting push-out guide surfaces, on which the engagement projections slide when the one of the pair of connectors is fitted into and disengaged from the fitting recess portion, formed respectively on opposite inner side surfaces of the fitting recess portion; and engagement portions respectively formed on the opposite inner side surfaces of the fitting recess portion, the engagement portions retaining the engagement projections when the one of the pair of connectors is completely fitted in the fitting recess portion.

2. A connector lock mechanism according to claim 1, further comprising:

retaining projections respectively formed on the elastic piece portions; and a retaining portion retaining the retaining projections, the retaining portion being formed on an inner surface of the fitting recess portion of the other one of the pair of connectors.

3. A connector lock mechanism according to claim 1, wherein the portions of the elastic piece portions, extending from the engagement projections in the connector fitting direction, are thinner than portions of the elastic piece portions extending rearwardly from the engagement projections.

4. A connector lock mechanism according to claim 1, wherein respective length of the portions of the elastic piece portions, extending from the engagement projections in the connector fitting direction, are larger than respective length of portions of the elastic piece portions extending rearwardly from the engagement projections.

* * * * *